United States Patent [19]

Kerkenbush et al.

[11] 4,340,222

[45] Jul. 20, 1982

[54] GAME BALL

[75] Inventors: Darle L. Kerkenbush, Diamond Bar; Peter P. Blaszcak, Jr., Sierra Madre, both of Calif.

[73] Assignee: Wham-O Mfg. Co., San Gabriel, Calif.

[21] Appl. No.: 164,280

[22] Filed: Jun. 30, 1980

[51] Int. Cl.[3] ..... A63B 41/10; A63B 39/08

[52] U.S. Cl. ..... 273/61 R; 273/58 K; 273/DIG. 20; 264/328.1

[58] Field of Search ..... 273/65 C, 65 D, 58 K, 273/65 EC, 65 ED, 58 B, 58 BA, 61 R, 61 C, 61 D, DIG. 20

[56] References Cited

U.S. PATENT DOCUMENTS

| | | | |
|---|---|---|---|
| 1,596,320 | 8/1926 | Sonnett | 273/65 D |
| 2,035,774 | 3/1936 | Trobridge et al. | 273/61 C |
| 2,085,369 | 6/1937 | Kilborn | 273/65 D |
| 2,288,889 | 7/1942 | Costello | 273/65 D |
| 2,597,704 | 5/1952 | Carlson | 273/61 A |
| 2,710,623 | 6/1955 | Kolos | 273/65 D X |
| 2,975,823 | 3/1961 | Ponnock | 273/61 A |
| 3,032,345 | 5/1962 | Lemelson | 46/DIG. 1 |
| 3,927,881 | 12/1975 | Lemelson | 273/58 K |

*Primary Examiner*—George J. Marlo

*Attorney, Agent, or Firm*—Christie, Parker & Hale

[57] ABSTRACT

A tennis ball consisting of two identical hemispheres joined together and including small upstanding integral fingers molded into the outer surface of the ball to provide surface texture, and enable the ball to grip the surface of the racquet. Each hemisphere incorporates an integrally molded plug in the interior of the hemisphere for providing means for introducing pressure into the ball. One or both of the plugs are pierced by a needle during fabrication to provide a conduit for a needle valve inflating device. A cylindrical sphincter is placed around the inflation plug during manufacture to squeeze the plug and prevent the escape of air when the ball is inflated. The ball is manufactured by first injection molding the hemispheres and then placing the hemispheres in facing mold halves. The hemispheres are provided with a rim of material to enable the hemispheres to be held in the mold, and a hot plate is inserted between the halves, which are then advanced and pressed against the plate rendering the abutting surfaces soft and partially molten. The plate is then withdrawn and the mold halves pressed together to fuse the rims of the two hemispheres together. The ball is then removed from the mold and the excess rim material removed leaving a round, hollow inflatable ball of predetermined size and surface texture.

7 Claims, 15 Drawing Figures

GAME BALL

BACKGROUND OF THE INVENTION

The present invention relates to inflatable objects in particular to an inflatable ball provided with an elastomeric inflation valve.

In a companion application, Ser. No. 164,279, now abandoned, filed of even data herewith a racquet is disclosed which is intended for use in a wide number of applications and for simulating a significant number of racquet-type games. An important aspect of this new racquet and the games in which it is intended to be used for play is that it lends itself readily to the playing of such games in areas of very limited size. To complement the racquet, a ball of a particular design is also provided. This ball is formed of a thermoplastic material which enables it to be quickly, conveniently and economically fabricated by an injection molding process and thereafter assembled by a unique process which is an aspect of the present invention. The ball is characterized by a high degree of elasticity lending itself to inflation at selectable pressures and sizes thereby adding to or inhibiting the bouncing qualities of the ball and adapting the ball for use in an area or enclosure of a particular size and surface texture.

Although discussed primarily in relation to the game of tennis, the racquet, which is the subject of the companion application, and the ball which is the subject of the present application, are likewise readily adaptable in size and configuration to racquet sports of all of the conventionally well-know types, such a squash or racquet ball.

CROSS REFERENCE TO RELATED APPLICATION

This application is related to the following companion application directed to a racquet used with the inflatable ball of this invention:

Ser. No. 164,279, now abandoned, filed of even date herewith and entitled "Game Racquet for Playing Racquet Sports in Limited Areas". The subject matter and the disclosure of the foregoing application is incorporated herein by reference.

SUMMARY OF THE PRESENT INVENTION

In one aspect the present invention provides an elastic hollow inflatable object comprising a first portion conforming in outline to one-half of the overall object, the first portion having a rim of a predetermined outline. A second portion is provided conforming an outline to the second half of the overall object and has a rim which is a mirror image of the first rim. The second portion is joined to said first portion along their respective rims by means of a fusion bond. A valve is molded into the interior of the first half. The valve is created by integrally modling a plug of material from which the object is formed into the interior of said first half with the plug extending away from the inner wall of said first half into the interior of the object. The plug is pierced to provide a path for the introduction of an inflating gas into the interior of the object and a collar is disposed about the plug having a transverse dimension smaller than the plug such that the collar squeezes the plug creating a constriction valve to prevent the escape of gas introduced into the interior of the object.

In another aspect, the invention provides a method for molding an elastomeric plastic object comprising the steps of injection molding a first hemisphere and a second hemisphere. The first and second hemispheres are then placed in molding fixtures face to face attitude and a heated plate is inserted between the fixture halves. Thereafter the fixture halves are moved axially toward each other to contact the rim of each hemisphere with the hot plate to soften and liquify the rims of each of the hemispheres. The fixtures are then retracted and the hot plate removed from a position from between the fixtures and the fixtures are then advanced together again to contact the liquified rims of each of the hemispheres to fuse and bond the hemispheres together. The formed sphere is then removed from the fixtures and the excess rim material is removed from the surface of the ball to provide a round sphere of a predetermined surface texture.

The result of the process is a soft inflatable hollow elastic object such as a ball which is adaptable for the simulated play of a number of racquet games. The ball is provided with a construction valve into which a conventional needle valve is inserted for inflation of the object. A conventional bicycle air pump, a specially designed hand air pump, or other air pumping means is connected to the needle valve to inflate the object to exactly the desired pressure and size. Depending upon the size and space in which the racquet game is to be played the ball is inflated to an appropriate pressure so that the striking of the ball with a normal stroke will enable the players to conveniently maintain the ball in play. Although described in conjunction with the molding of a sphere the method of the present invention of applies as well to the molding of other objects including other toys and other articles made of a heavy duty plastic particularly those which require inflation for functioning. By utilizing thermoplastic materials, the ball of the present invention provides a means whereby a substantial range of sizes can be obtained, including inflation of the object to a size approximately twice its normal size.

In its presently preferred embodiment, the inflatable object of the present invention is an enlarged simulated tennis ball. The ball is adjustable in terms of its size and hardness by means of the amount of pressure introduced therein. By fabricating it of a lightweight material, and enlarging it in comparison to a conventional tennis ball, the ball has considerable air resistance when hit by a racquet, which causes rapid loss of in-flight speed after the hit. The resulting short flight enables the players to keep the ball in play in a limited area, even when hit with the normal power of an adult swing. Further adjustment of the speed and distance of flight, as well as the bounce, is obtained by increasing or reducing the internal gas pressure in the ball by means of the needle valve and pump. Typically, the ball is adjustable from 4 to 6 inches in diameter. The enlarged size and material of the ball, together with the ability to pressurize it, enables the ball to achieve a satisfactory high bounce on almost any surface, including sand, dirt, grass, wood, or concrete.

Further refinements of the ball include molding a special texture into the surface of the ball to more closely simulate the appearance of a tennis ball and to provide a texture which enables the user, when stroking it with a racquet, to impart a high degree of spin or "english" to the ball, thereby yielding increased ball control. Such a texture, in combination with other characteristics of the ball, including its lightweight and large surface area, enables the players to produce exaggerated flight paths of the ball, including dips, rises, and curves, when underspin, topspin, and sidespin is imparted to the ball.

These and other advantages of the present invention will be better understood by reference to the figures of the drawing wherein.

DETAILED DESCRIPTION OF A SPECIFIC EMBODIMENT

Figure 1:
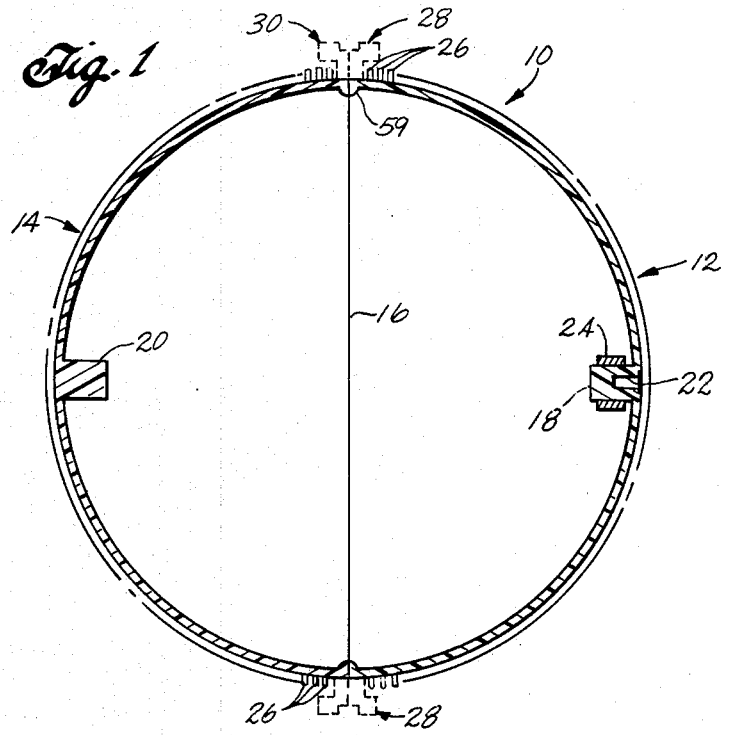
FIG. 1 is a sectional view in elevation of a molded object according to the present invention.

A hollow inflatable ball molded according to the principles of the present invention is shown in FIG. 1. The view in FIG. 1 is a sectional view showing a ball 10 comprising two hemispheres 12 and 14, which are joined edgewise along a centerline 16. The two hollow hemispheres 12 and 14 are joined by a fusion bonding process for hollow objects, which is an important aspect of the present invention. As shown in FIG. 1, a cylindrical plug 18 is integrally molded to the interior of hemisphere 12, and a similar solid, cylindrical plug 20 is integrally molded to the interior of hemisphere 14. Plugs 18 and 20 are positioned in the center of their respective hemispheres, that is, at a spacing which is equidistant from all points on the rim of its respective hemisphere. Hemisphere 12 is molded such that plug 18 has a recess 22 countersunk into the plug extending from the exterior of the ball a predetermined distance into, but not through, plug 18. Recess 22 is provided to act as a guide for an inflation needle. A ring 24, preferably of an elastic material, is disposed circumferentially about plug 18 and, as the subsequent discussion will disclose, acts as a sphincter for sealing a constriction valve, which plug 18 and ring 24 comprise, and through which the inflation needle is inserted when it is desired to inflate or deflate the ball.

To enable the ball 10 of this invention to more nearly simulate the outward appearance of a tennis ball, with its fabric or mottled cover, the ball 10, which is fabricated of an elastomeric plastic or of a thermo-forming material, has an extremely large plurality of small individual fingers 26 of the material from which the ball is fabricated molded into the outer surface of the ball. Representative samples of such fingers 26 are shown at the top and bottom of the ball and, as the construction line of the drawing indicates, extend around and cover the entire outer surface of the ball, except for a smooth endless seam (shown in FIGS. 6 and 8), which extends around the surface of the ball in an arcuate pattern, to further simulate the outward apearance of a tennis ball. The special deep-surface texture to the ball provided by fingers 76 have an important functional aspect. When struck by a string racquet or paddle, the fingers "grip" the surface of the racquet, enabling the user to impart a very high degree of spin to the ball. This high frictional engagement of racquet and ball enables the user to make the ball perform dramatic and exaggerated dips, curves, and rises, depending on the kind of spin imparted to the ball.

Hemisphere 12 is shown with the ghosted outline of a rim 28 disposed around the rim or edge of the hemisphere and extending outwardly therefrom. A similar rim 30 is provided on hemisphere 14. Rims 28 and 30 are used during the bonding process to seat and align hemispheres 12 and 14 in a fixture to firmly and accurately register the hemispheres with each other so as to permit the edges of the respective hemispheres to be joined together.

An important aspect of the present invention is the fabrication of a ball wherein the ball is fabricated by an injection molding process into identical halves with the halves thereafter being joined together around their respective rims by a fusion-bonding process. By the use of an injection molding process, a manufacturing technique is utilized which permits the ball to be made of soft elastomeric materials. Such a process is a significant factor in the substantial economy of manufacture realized by the ball of the present invention and is also a significant factor in providing a ball which is soft and pliable, while at the same time lending itself to being made harder or softer, as well as larger or small, by inflation with air pressure. The use of an injection molding technique also enables distinctive surface treatments to be utilized and imparted to the ball, such as a surface simulating the exterior surface of a tennis ball.

Figure 2A:
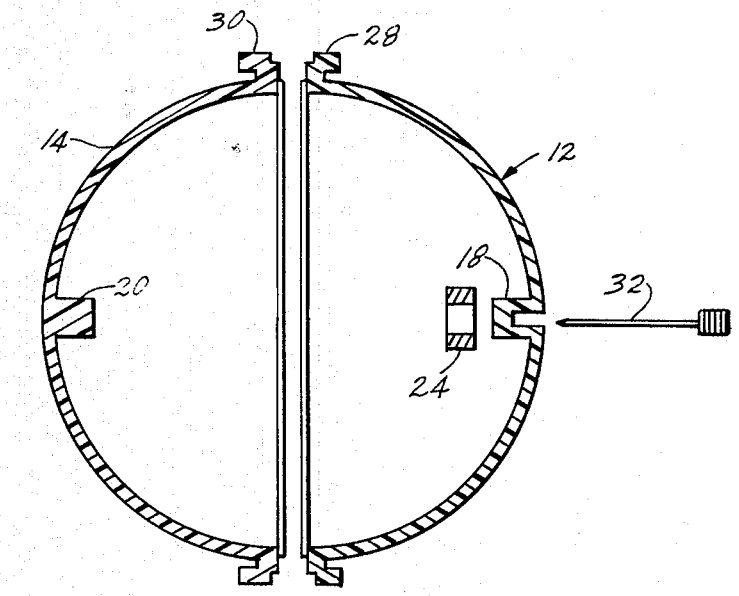
FIG. 2A is a sectional view in elevation of the object of FIG. 1 in the proces of manufacture.
Figure 2B:
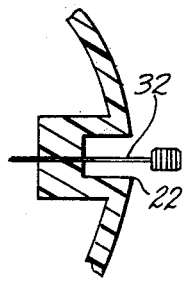
FIGS. 2B and 2C are detailed views of the hemisphere shown in FIG. 2A illustrating further steps of the process of manufacture.
Figure 2C:
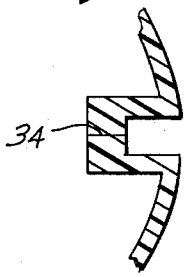

The steps of the fabricating process are illustrated in FIGS. 2A–2G. In FIG. 2A, hemispheres 12 and 14 are illustrated in sectional view as they appear after injection molding with their respective rims 28 and 30 extending outwardly from the hemispheres as a circumscribing flange. Plugs 18 and 20 are likewise illustrated in FIG. 2A, as is sphincter 24 prior to its placement about plug 18. As indicated above, each hemisphere is fabricated by an injection molding process of a nonlinear elastomeric material. The use of a nonlinear material assures that as the material sets and assumes its final configuration, the two halves of the ball will undergo uniform shrinkage such that the hemispheres of each side of the ball will maintain their congruity to permit their being bonded together rim-to-rim. After the hemispheres are removed from the injection mold, a sharp needle 32 is positioned opposite recess 22 and driven axially through plug 18 into the interior of the hemisphere to create a passage through plug 18 and provide a valve for later use in inflation of the ball. The valve 34 is shown in FIG. 2C after needle 32 has been removed.

After the removal of needle 32, ring 24, which has an inner diameter smaller than the outer diameter of plug 18, is stretched and placed over plug 18 to act as a sphincter, squeezing down and compressing valve 34 to prevent the escape of air therethrough from the interior of the ball after it is inflated. A ring of a rigid material can also be used in lieu of ring 24, which is force-fitted over plug 18.

Figure 2D:
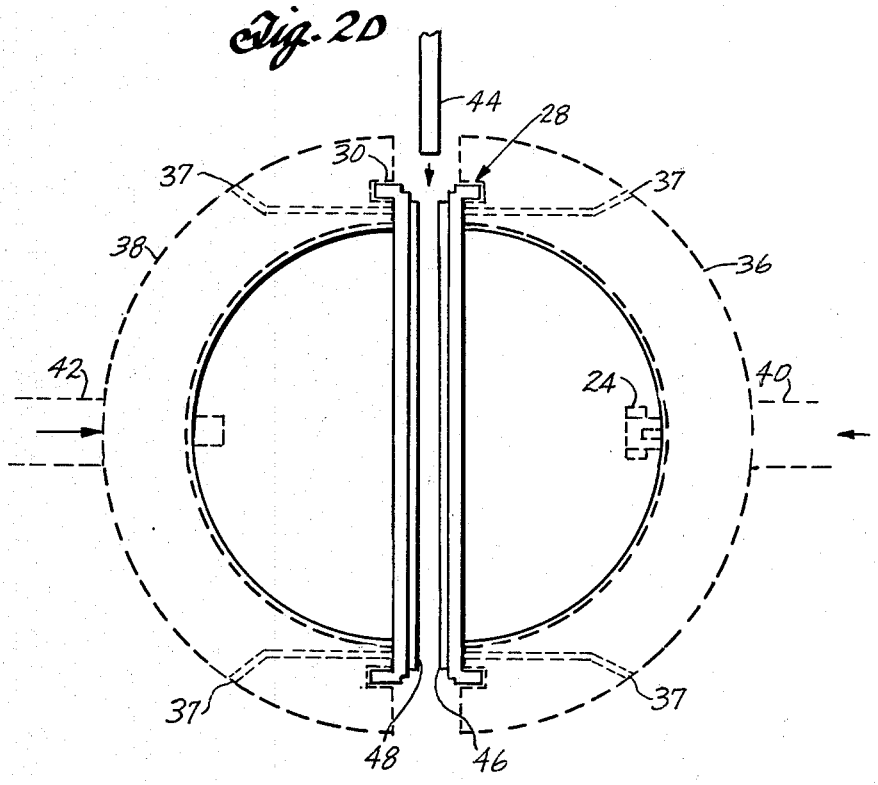
FIGS. 2D through 2G are elevation views of the object according to the present invention in the various stages of the fabricating and bonding process of the present invention.
Figure 2E:
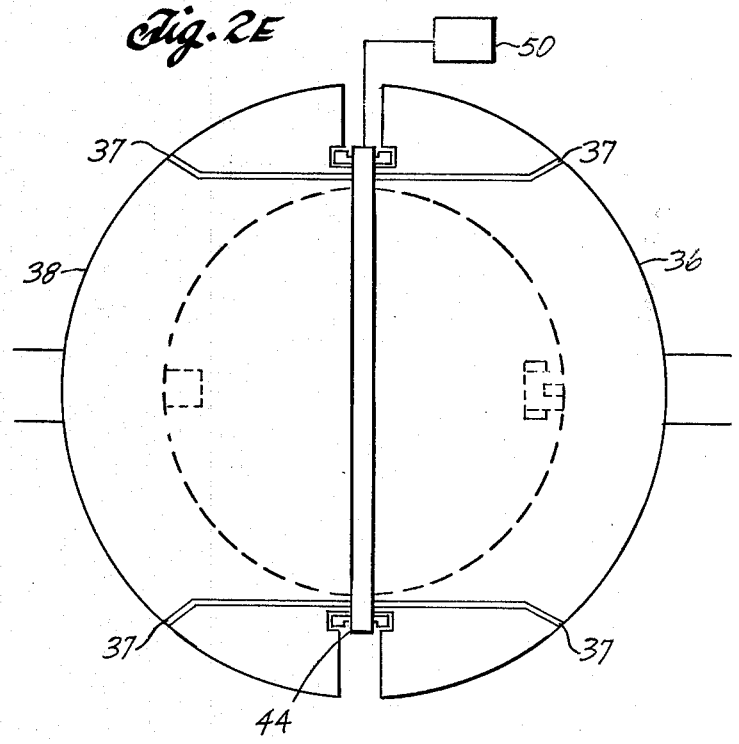
Figure 2F:
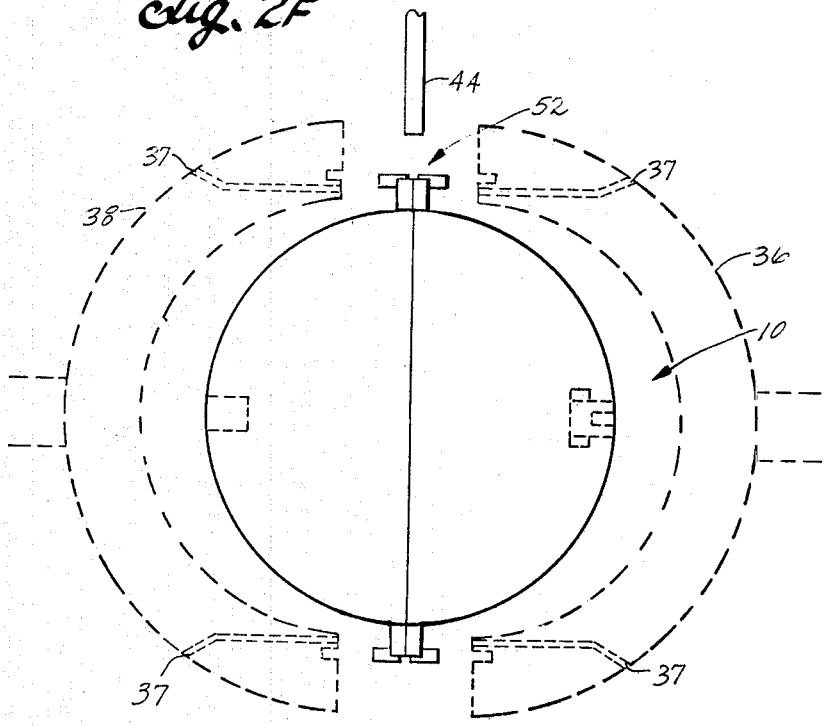

The two halves or hemispheres 12 and 14 are now ready to be bonded together. Hemisphere 12 is seated in a fixture half 36, and likewise hemisphere 14 is seated in a fixture half 38. Fixtures 36 and 38 are supported respectively by support arms 40 and 42. In FIGS. 2D and 2F, fixture halves 36, 38 are shown in ghosted outline to more clearly illustrate their positional relations to the hemispheres. The fixture halves are shown in solid outline in FIG. 2E. A heated plate 44 is positioned so as to be inserted between hemispheres 12 and 14 as they are held within their respective fixture halves. Rims 28 and 30 act as guides to securely seat their respective hemispheres in the fixture halves and enable the hemispheres to be properly aligned and mated prior to being bonded together. To further secure the hemispheres in their respective fixtures a series of ports 37 extend through fixtures 36, 38 through which a vacuum is applied when the hemispheres are in place. Drawing a vacuum on the rims holds them securely in place on the mold and prevents distortion of the elastomeric material when the hemispheres are brought to bear against plate 44 or against each other during the interval of bonding.

As is seen in FIG. 2D, each hemisphere has a lip or ring of material 46, 48 raised from the circular edge or mouth of hemispheres 12 and 14, respectively, defining the surfaces and the material which is fused together when the ball halves are joined. Plate 44 is heated to a temperature equal to or above the melting point of the material from which the ball is fabricated, and when the halves are to be joined together, plate 44 is inserted between the fixture halves as shown in FIG. 2E. Electric power is supplied to plate 44 by power supply 50, and the molds are moved axially toward each other such that the rings 46, 48 of elastomeric material of each hemisphere contact and seat against hot plate 44, heating the rings and raising the temperature of the material in the rings to a molten state.

Figure 2G:
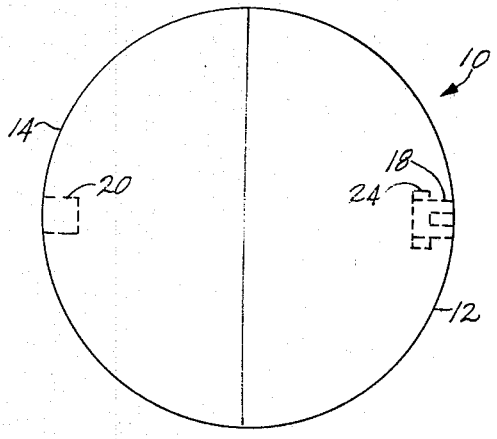

Thereafter, the fixture halves are retracted while still holding the respective hemispheres therein, and plate 44 is withdrawn. The fixture halves are then axially advanced again toward each other, and the molten edges of the ball halves are brought together into a strong physical contact by pressure exerted by the fixture halves. The molten material at the edge or rim of each of the ball halves fuses with the molten material on the opposite half, and, after being held together for a predetermined amount of time to permit the molten material to cool and the bonding process to complete itself, mold halves 36, 38 are withdrawn, as shown in FIG. 2F, leaving a sealed sphere or ball 10, having a flange 52 of material extending around the ball at the equator thereof. Flange 52 is comprised of rims 28 and 30, respectively. The fabrication process of the ball is completed by removing flange 52 by one of a number of possible processes, including die-cutting the excess material around the circumference of the ball 10, leaving the completed and molded sphere as shown in FIG. 2G, which is sealed completely around its equator by a fusion bond and has molded internally therein an inflation valve comprised of plug 18 and ring 24 in hemisphere 12 and a dummy plug 20 in hemisphere 14. Plug 20, positioned opposite plug 18, serves as a counterbalance to plug 18.

Figure 3:
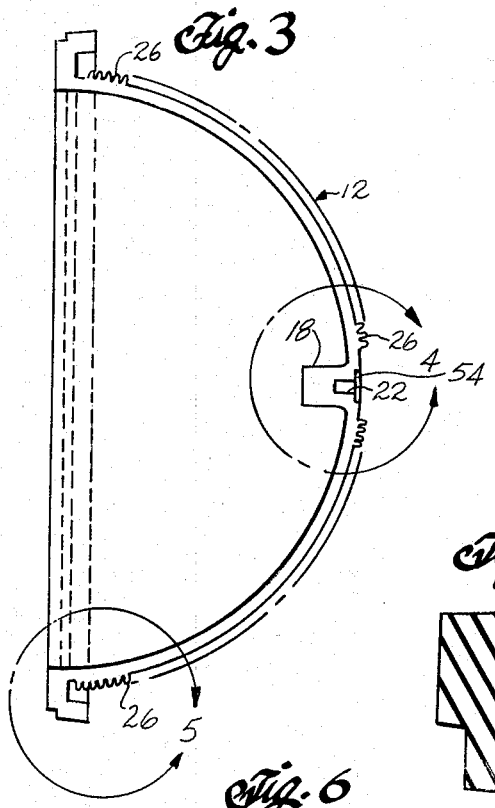
FIG. 3 is a sectional view in elevation of a hemisphere of a ball to be fabricated and bonded according to the present invention showing details of the valve and surface texture.
Figure 4:
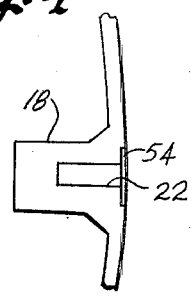
FIG. 4 is an enlarged detail view in section taken along line 4—4 of FIG. 3.
Figure 5:
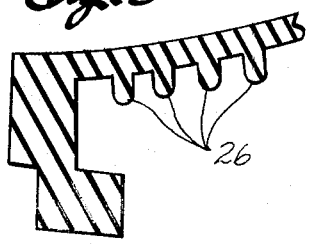
FIG. 5 is an enlarged detail view in section taken along line 5—5 of FIG. 3.
Figure 6:
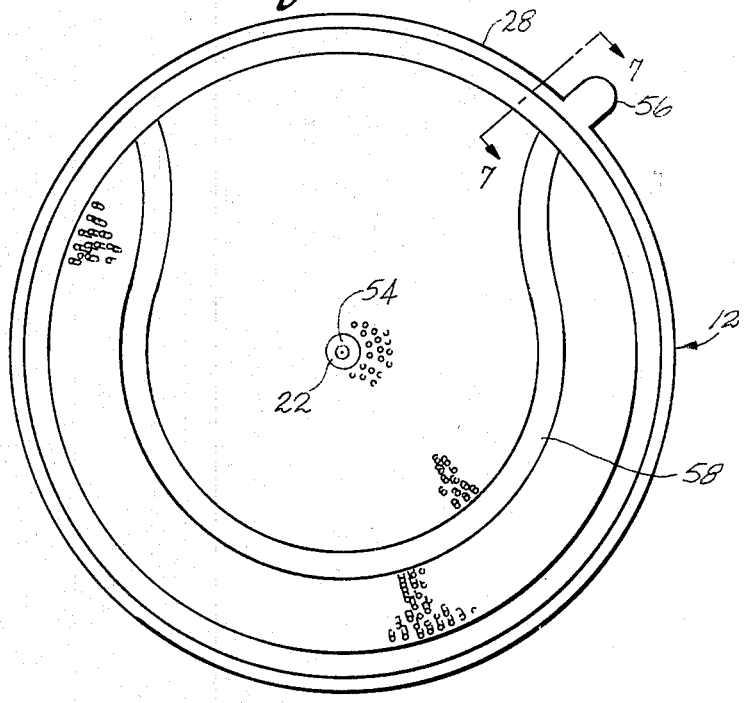
FIG. 6 is a plan view of the hemisphere shown in FIG. 3.
Figure 7:
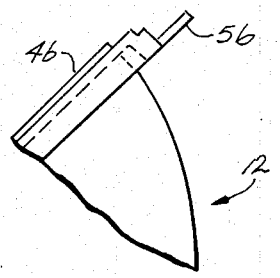
FIG. 7 is an enlarged detail view in section taken along line 7—7 of FIG. 6.
Figure 8:
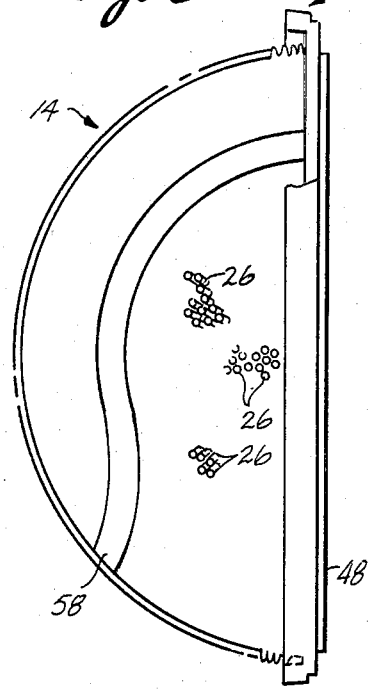
FIG. 8 is an elevation view of the hemisphere opposite the hemisphere shown in FIG. 3.

Further details of hemisphere 14 are shown in FIGS. 3–6. Hemisphere 12 is shown as it emerges from the injection mold in which it is fabricated and has molded integrally as a part thereof rim 28 and fingers 26 raised from the surface thereof. Plug 18 is likewise shown with recess 22 countersunk therein and a shallow, wider recess 54 also countersunk into the surface of hemisphere 12 coaxial with recess 22. As the enlarged view of FIG. 5 clearly illustrates, the fingers 26 are raised from the exterior surface of hemisphere 12. Fingers 26 are obtained by drilling the inner surface of mold 36 in a random manner over the entire inner surface thereof with a drill having a diameter of approximately 0.050″. The plan view of hemisphere 12, in FIG. 6, illustrates the exterior appearance of the surface of the ball and the inflation valve of the ball and shows recesses 54 and 22 in still greater detail. A tab or finger 56 is formed into rim 28 to facilitate the handling of the hemispheres 12, 14 in the placement of each hemisphere in the respective fixture during the fusion bonding process to align the seams 58 on the two halves. Additional details of finger or tab 56 are shown in FIG. 7, a view taken along line 7—7 of FIG. 6, as are details of the ridge or shoulder of material 46, which is raised from the rim of hemisphere 12 during the injection molding phase. As best seen in FIG. 1, the material of ridge 46 results in a hump of material 59 located interiorly of the ball and extending around the equator thereof, providing a slight thickening to the wall thickness of the ball at the point of juncture to further strengthen and reinforce the joint. An elevation view of hemisphere 14, similar to the view shown in FIG. 3, is shown in FIG. 8. As shown therein, the outer surface of the ball has minute fingers 26 of the ball material raised from the surface thereof to impart a deep resilient surface texture and appearance to the outer surface of the ball. Likewise, rim 30 is shown, as is ridge 48. The simulated tennis ball seam 58, which is molded into the surface of the ball in an arcuate pattern extending around the surface thereof, is also shown in FIG. 8 and in FIG. 6.

Figure 9:
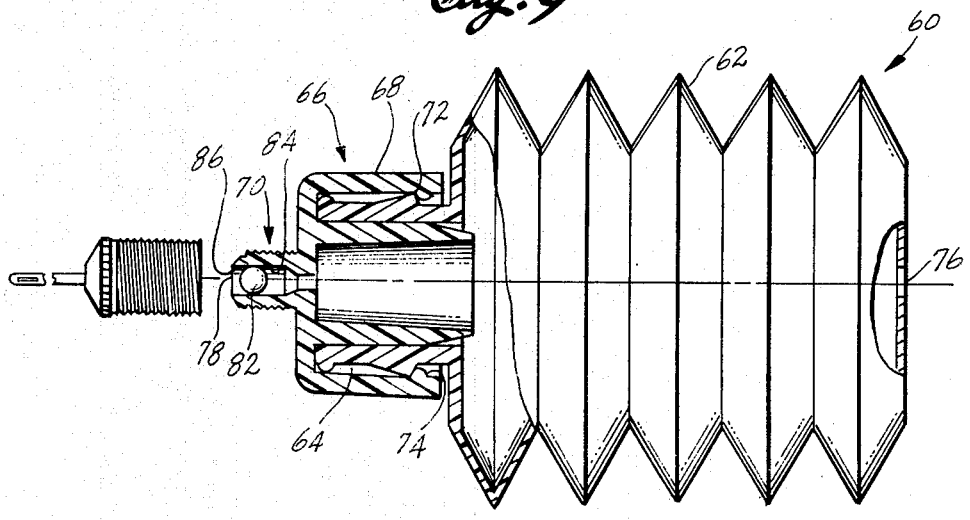
FIG. 9 is an elevation view partially in section of a hand pump and inflation needle used for inflating the ball of the present invention.

An embodiment of the presently preferred apparatus for inflating the ball of the present invention is shown in FIG. 9. As shown therein, pump 60 comprises a flexible bellows 62, which is generally cylindrical and terminates at one end in a neck portion 64 of a predetermined configuration. A molded cap 66 is shown seated over neck 64 in snapped engagement therewith. Cap 66 comprises a base portion 68 and a head portion 70, which is externally threaded to receive a needle valve 80, which is adapted to be threadedly engaged therewith. A shoulder 72 is shown molded into the outer surface of neck 64 and positioned so as to matingly engage a ring 74 molded into the interior surface of cap 66 in registration therewith so as to lock cap 66 onto neck portion 64.

When needle valve 80 is mounted in position on head 70, and the bellows is axially and alternately collapsed and expanded, air is admitted into the interior of the bellows through aperture 76. Upon the compression stroke, air contained within the bellows is pumped out around check ball 82 through an opening 78 in head 70, through the needle valve, and into the interior of the ball into which the needle valve has been inserted. Check ball 82 is located in passage 84 through head portion 70. Ball 82 acts as a check valve for the pump to prevent air from escaping from the ball during the compresion stroke of the pump. A crease 86 is imparted to opening 78 to return ball 82 in passage 84. In the decompression stroke, the bellows 62 expands and moves away from head 70, and air is drawn into the bellows 62 through aperture 76 for the next pumping stroke. Depending upon the game to be played with the ball, and the particulars of the surface and space in which the game is to be played, the pump 60 is used to inflate the ball to a greater or lesser degree, producing the desired degree of hardness or softness and the desired ball diameter to suit various playing conditons.

What is claimed is:

1. A hollow, spherical ball comprising:

a flexible thermoplastic spherical envelope having an interior surface and an exterior surface;

a constriction valve integrally formed in the interior surface of the ball, the constriction valve comprising a molded plug of solid material having a passage extending through the plug for providing a path for the introduction of an inflating gas with the interior of the ball;

a collar disposed about the plug, the collar having a traverse dimension smaller than the plug for compressing and constricting the plug and the gas introduction path to prevent the escape of gas introduced therein; and a plurality of upstanding fingers raised from the exterior surface of the ball and covering a substantial portion of the entire surface thereof.

2. A ball according to claim 1 wherein the exterior surface of the ball defines a path of a predetermined configuration through the upstanding fingers on the exterior surface of the ball to thereby simulate the seam of a ball.

3. A ball according to claim 1 wherein the path and the simulated seam have the configuration of a tennis ball.

4. A ball according to claim 1 wherein the plug of solid material is a cylinder shape of a predetermined diameter and the passage penetrating the plug lies along the axis of the cylinder.

5. A ball according to claim 4 wherein the collar is a ring of an elastic material with an inside diameter and an outside diameter, the inside diameter of the collar having a diameter smaller than the diameter of the cylindrical plug.

6. A ball according to claim 4 wherein the collar comprises a ring of an inelastic material having an inside diameter and an outside diameter, the inside diameter being smaller than the diameter of the plug.

7. A ball according to claim 1 wherein the plurality of upstanding fingers are disposed on the exterior of the ball so as to define a surface having predetermined portions where the surface is textured and predetermined portions where the surface is untextured for the purpose of creating a ball having desired aerodynamic or visual characteristics.

* * * * *